US007658584B2

(12) United States Patent
Yoshie et al.

(10) Patent No.: US 7,658,584 B2
(45) Date of Patent: Feb. 9, 2010

(54) BOOKBINDING APPARATUS

(75) Inventors: Kohji Yoshie, Sagamihara (JP); Saburo Shimizu, Hachioji (JP); Riichi Hama, Hachioji (JP); Masahiro Kaneko, Hino (JP); Kiyoshi Hata, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 575 days.

(21) Appl. No.: 11/453,905

(22) Filed: Jun. 16, 2006

(65) Prior Publication Data

US 2007/0036638 A1 Feb. 15, 2007

(30) Foreign Application Priority Data

Aug. 11, 2005 (JP) ..... 2005-232902
Apr. 27, 2006 (JP) ..... 2006-123184

(51) Int. Cl.
*B42C 13/00* (2006.01)
*B42C 11/02* (2006.01)
*B42B 9/00* (2006.01)
*B42C 11/04* (2006.01)

(52) U.S. Cl. ..... 412/11; 412/19; 412/20; 412/21; 412/22

(58) Field of Classification Search ..... 412/4–6, 412/8, 11, 14, 19–22; 270/58.09; 271/265.04
See application file for complete search history.

(56) References Cited

U.S. PATENT DOCUMENTS 4,904,138 A * 2/1990 Champeaux et al. ..... 412/8
5,061,138 A * 10/1991 Allsopp et al. ..... 412/4
5,252,018 A * 10/1993 Kitahara et al. ..... 412/11
6,447,230 B1 * 9/2002 Takai et al. ..... 412/14
7,413,177 B2 * 8/2008 Mori et al. ..... 270/58.09

* cited by examiner

*Primary Examiner*—Dana Ross
*Assistant Examiner*—Kyle Grabowski
(74) *Attorney, Agent, or Firm*—Finnegan, Henderson, Farabow, Garrett & Dunner, L.L.P.

(57) ABSTRACT

There are provided bookbinding apparatuses that wrap a bundle of sheets with a cover and form back corners, and have a detecting unit for detecting a wave amount of a bundle of sheets. A type of such an apparatus includes a controller to control a time period to form back corners, based on a result of detection by the detecting unit. Another type of such an apparatus includes a controller to control a pressure applied to form back corners, based on a result of detection by the detecting unit. Still another type of such an apparatus includes a controller to control a time period and pressure applied to form back corners, based on a result of detection by the detecting unit.

12 Claims, 9 Drawing Sheets

BOOKBINDING APPARATUS

FIELD OF THE INVENTION

The present invention relates to a bookbinding apparatus that binds a book by wrapping a bundle of sheets with a cover, and in particular, to bookbinding quality on the folded portion of a spine.

BACKGROUND OF THE INVENTION

As a bookbinding apparatus that binds a book by wrapping a bundle of sheets with a cover, there has been an apparatus wherein the back of a bundle of sheets and a cover are pasted together with a liquid state adhesive or an adhesive tape. For example, Unexamined Japanese Patent Application Publication No. H09-156249 discloses a means wherein the side edges of the bundle of sheets are lined up on a table, the bundle of sheets thus lined up is clamped at a sheet fixing portion, and the bundle of sheets thus clamped at a sheet fixing portion is caused by a sheet fixed portion moving means to reciprocate between a paste spreading roller that spreads paste on the back of the bundle of sheets and a dryer portion that dries the pasted portion forcibly. Further, Unexamined Japanese Patent Application Publication No. 2004-351726 discloses a means wherein adhesives are sufficiently solidified by measuring ambient temperature after coating adhesives on the back and thereby controlling interposing time for clamping.

However, in the apparatus that binds a book by wrapping a bundle of sheets with a cover, when bookbinding is performed by wrapping a bundle of sheets with a cover, if the bundle of sheets is sandwiched in a wavy form, there has been a problem that corners of the spine do not become straight lines and the spine does not become flat, even conducting folding formation (back corner forming) of the spine by pressing a cover against the bundle of sheets.

Means to solve the aforesaid problems is not described in any of the aforesaid Nos. H09-156249 or 2004-351726.

SUMMARY OF THE INVENTION

The present invention includes the following structures.

(1) A bookbinding apparatus that wraps a bundle of sheets with a cover and forms back corners, including:

a detecting unit for detecting a wave amount of a bundle of sheets; and a controller to control a time period to form back corners, based on a result of detection by the detecting unit.

(2) A bookbinding apparatus that wraps a bundle of sheets with a cover and forms back corners, including:

a detecting unit for detecting a wave amount of a bundle of sheets; and a controller to control a pressing force applied to form back corners, based on a result of detection by the detecting unit.

(3) A bookbinding apparatus that wraps a bundle of sheets with a cover and forms back corners, including:

a detecting unit for detecting a wave amount of a bundle of sheets; and a controller to control a time period and pressing force applied to form back corners, based on a result of detection by the detecting unit.

DESCRIPTION OF THE PREFERRED EMBODIMENT

The invention will be described below, referring to the shown embodiment to which, however, the invention is not limited.

Figure 1:
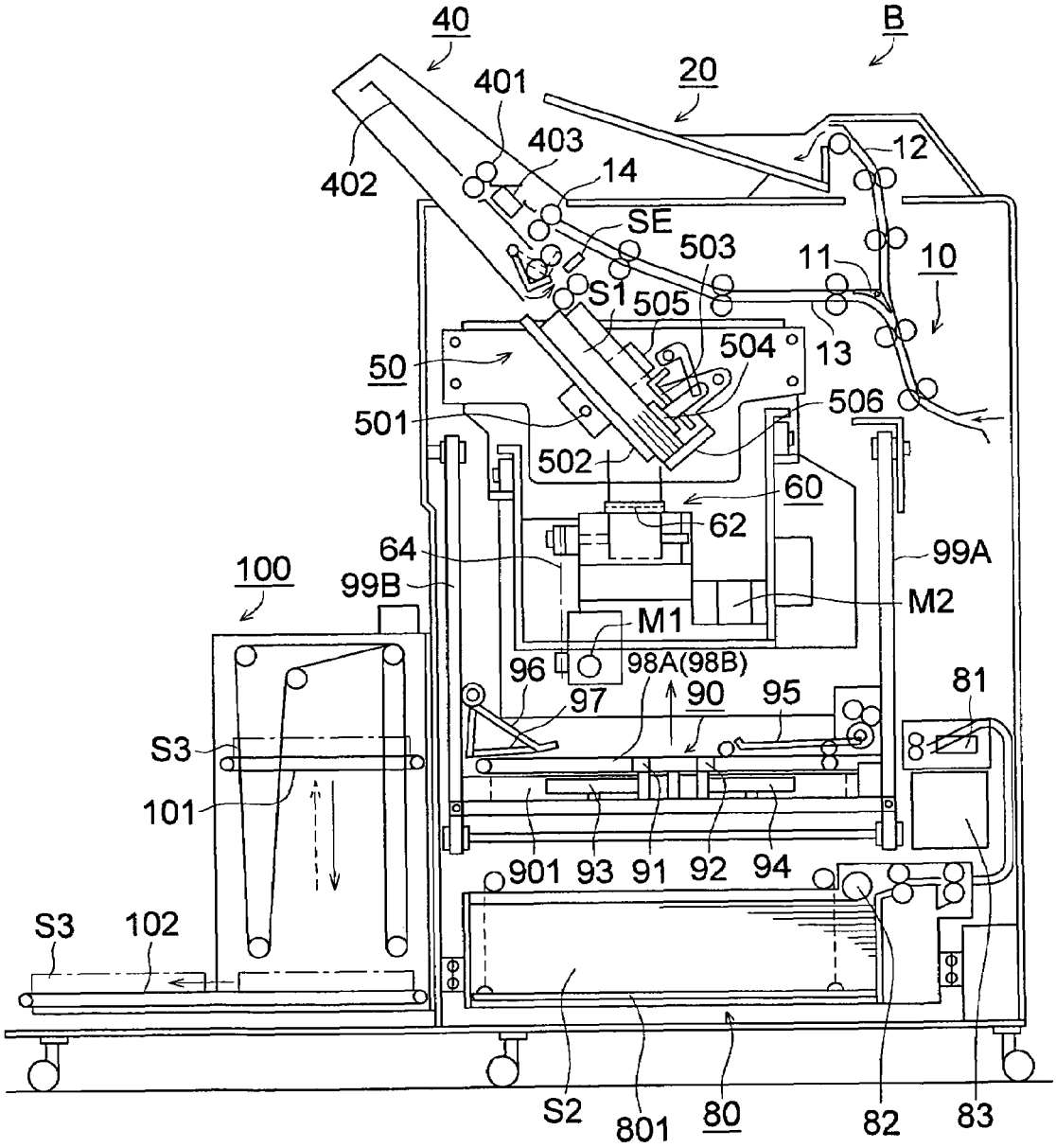
FIG. 1 is a front view of a bookbinding apparatus in accordance with an embodiment of the invention.

FIG. 1 is a diagram showing an entire bookbinding apparatus in an embodiment in accordance with the invention.

<Bookbinding Apparatus>

Bookbinding apparatus B includes conveying section 10 that conveys sheets S1 ejected from an image forming device (not shown) to sheet ejection tray 20 or to sheet reversing section 40, collecting section 50 on which sheets S1 fed in one by one from the sheet reversing section 40 are stacked, coating unit 60, cover storing section 80 that stores covers S2, cover supporting section 90 that supports a cover and book ejection section 100.

Sheet S1 ejected from the image forming device is ejected, by switching gate 11 provided on the conveying section 10, to sheet ejection tray 20 through ejection path 12 or to the sheet reversing section 40. Sheet S1 is ejected to the sheet ejection tray 20 in a mode other than the bookbinding processing mode.

A Sheet S1 is conveyed to the sheet reversing section 40 through conveyance path 13, and is caused to switchback at the sheet reversing section 40 to be conveyed to the collecting section 50. In the collecting section 50, when sheets S1 in a preset quantity are stacked, a bundle of the sheets S1 is sandwiched to be rotated, and is supported substantially vertical.

The coating unit 60 coats an adhesive on the back of the sheets S1 (a bottom end surface in FIG. 1) supported by the collecting section 50.

Cover S2 comes in contact with the bundle of sheets S1 on which the adhesive is coated, and is stuck to the bundle of sheets. Thus book S3 is produced and ejected to the book ejection section 100.

Each section of the bookbinding apparatus will be described in detail below.

Sheet S1 conveyed through conveyance path 13 is ejected by ejection roller 14, and is conveyed by oscillating pressure contact roller 401 to rise along tilted reversing tray 402. After that, the oscillating pressure contact roller 401 rotates reversely to convey the sheet S1 downward. The sheet S1 conveyed downward falls onto the collecting section 50 to be stacked thereon.

The sheet S1 which has descended along the sheet reversing section 40 is supported obliquely by a sheet supporting unit having supporting plate 502 and stopper plate 506 in the collecting section 50.

Sheets S1 ejected successively from the image forming device are collected on the collecting section 50 to form a bundle of sheets S1. The quantity of sheets S1 forming a bundle is recognized from the quantity of documents inputted by an operator in advance, the quantity of document counted by the use of an automatic document conveyance device mounted on the image forming device or the quantity of documents obtained from document image information transmitted through a personal computer.

A member 504 restrains lifting of collected sheet S1, and it moves off and presses down sheet S1 each time a single sheet S1 is supplied to the collecting section 50. An aligning plate 505 aligns side edges of sheets.

When sheets S1 in a preset quantity are collected in the collecting section 50, holding plate 503 works to sandwich a bundle of sheets S1 to hold it.

In a state where the bundle of sheets S1 is sandwiched and held, the collecting section 50 rotates about an axis of shaft 501 to move the bundle of sheets S1 to be vertical from its tilted posture.

<Coating Process>

Figure 2:
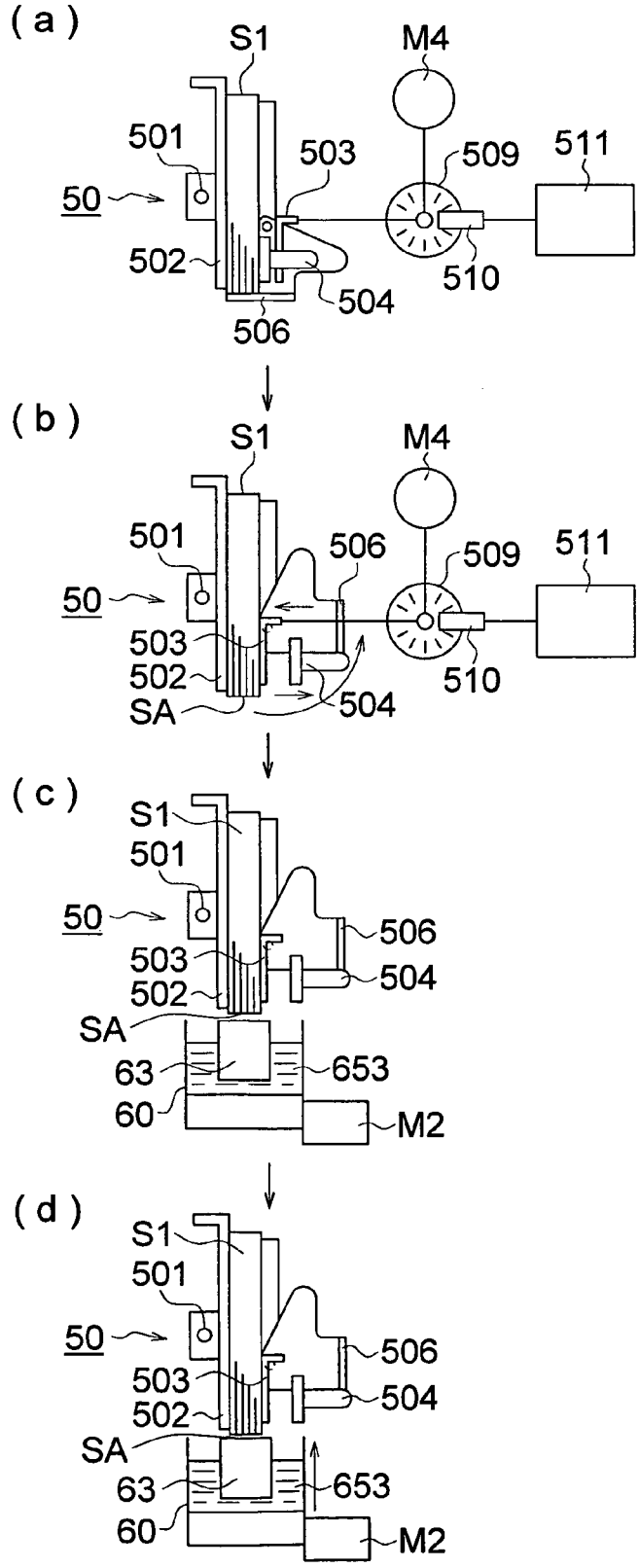
FIG. 2 is a diagram showing a process of coating an adhesive.

FIG. 2 shows a process to coat an adhesive while holding the bundle of sheets S1 vertically on the collecting section 50.

Before showing the coating process, holding of sheets by the holding plate 503 will be described below, referring to diagram (a) of FIG. 2.

Motor M4 drives to move the holding plate 503 to press a bundle of Sheets S1, and when it is detected that a driving torque caused by the pressing reaches a predetermined value, the holding plate 503 stops, thus, the bundle of sheets S1 is held firmly by the supporting plate 502 and the holding plate 503. A position for the holding plate 503 to stop is detected by encoder 509 and sensor 510 and stored in a storage device of position detection unit 511.

While the bundle of sheets S1 is being displaced toward the vertical state by rotating the collecting section 50 about the center of shaft 501, with the bundle of sheets S1 held, stopper plate 506 is rotated by 90° to retreat as shown in diagram (b) of FIG. 2.

In the state shown by diagram (c) of FIG. 2, bottom surface SA of the bundle of sheets S1 is away from coating roller 63.

Next, as shown by diagram (d) of FIG. 2, coating unit 60 containing therein hot melt adhesive 653 rises, whereby, coating roller 63 comes in contact with the bottom surface of the bundle of sheets S1 in the diagram, and moves in the direction perpendicular to the page of FIG. 2 to coat adhesive 653 on the bottom surface SA of the bundle of sheets S1.

Next, a coating process will be described below, referring to FIG. 3.

Figure 3:
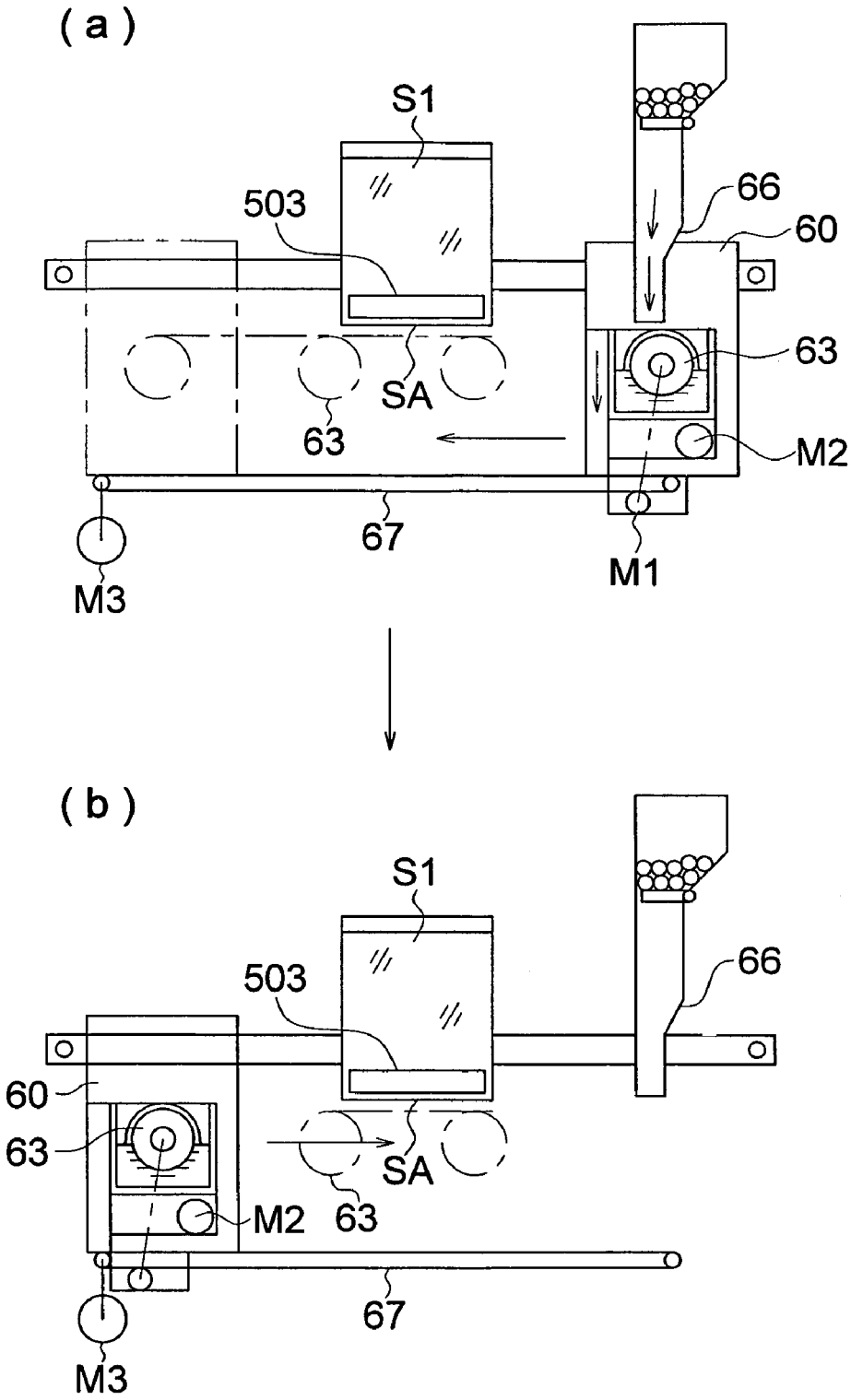
FIG. 3 is a diagram showing a movement of a coating head.

In diagram (a) of FIG. 3, coating unit 60 is at a right end position (first position) representing a home position at a stage of the start of bookbinding, and at this position, a solid type adhesive is supplied to coating unit 60 through supply path 66. The solid type adhesive thus supplied is heated and melted by the coating unit 60. The coating unit 60 moves leftward at the start of bookbinding process from the home position to the left end position (second position), driven by belt 67 (second moving unit) that is driven by motor M3, and this movement is started based on a signal which indicates that the front end of the last sheet S1, of sheets S1 to be collected in the collecting section 50, has been detected to pass, by sheet sensor SE which is provided at the immediate downstream side of reversing tray 402 (see FIG. 1). In the process where the coating unit 60 is moving to the left end position, coating roller 63 is away from the bottom surface of the bundle of sheets S1.

Then, in the stage shown by diagram (b) of FIG. 3 where the coating unit 60 moves toward a right end position from the left end position, coating roller 63 is driven by motor M2 to rise, and to come in contact with the bottom surface of sheet S1 to coat adhesive 653. With respect to the start of the coating process in diagram (a) of FIG. 3, timing of the process is controlled to start coating after the stop of conveyance of a cover that is cut by cutter 81 after the bundle of sheets S1 is set to the state allowing vertical coating. Herein, the right end position of coating unit 60 in FIG. 3 is a position on the back side of the apparatus when the apparatus is viewed from the front side of the sheet of FIG. 1, and the left end position of coating unit 60 in FIG. 3 is a position on the front side of the apparatus when the apparatus is viewed as the same.

Owing to this timing control, operations of respective portions are carried out sequentially, and bookbinding process is performed at high efficiency. After the coating unit 60 is moved to its home position, cover S2 is joined.

<Joining Process>

Next, the joining process for a bundle of sheets S1 and cover S2 will be described below, referring to FIGS. 4-8.

Figure 4:
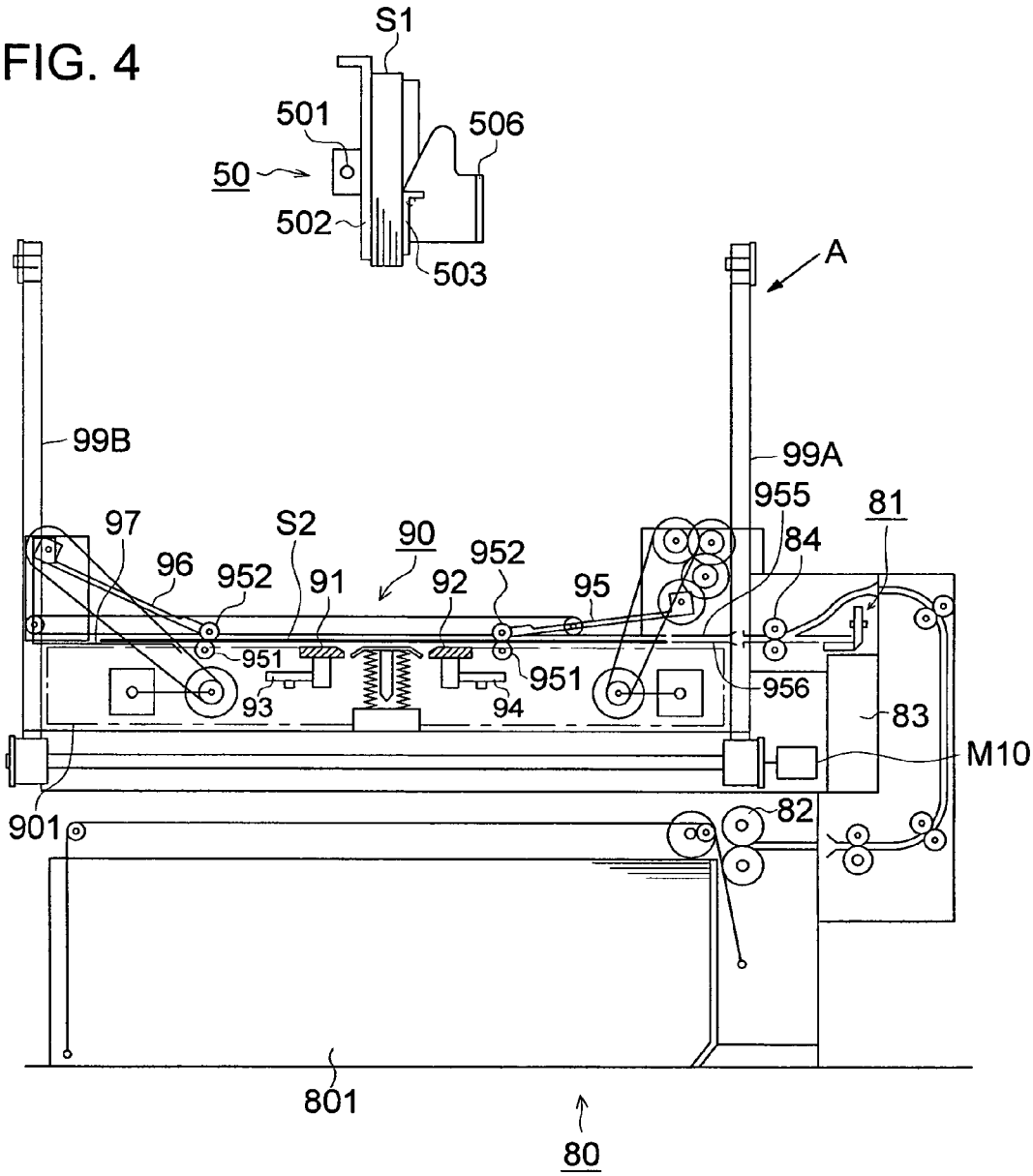
FIG. 4 is a schematic cross-sectional view relating to cover supporting section 90 that supports a cover loading section and a cover.
Figure 5:
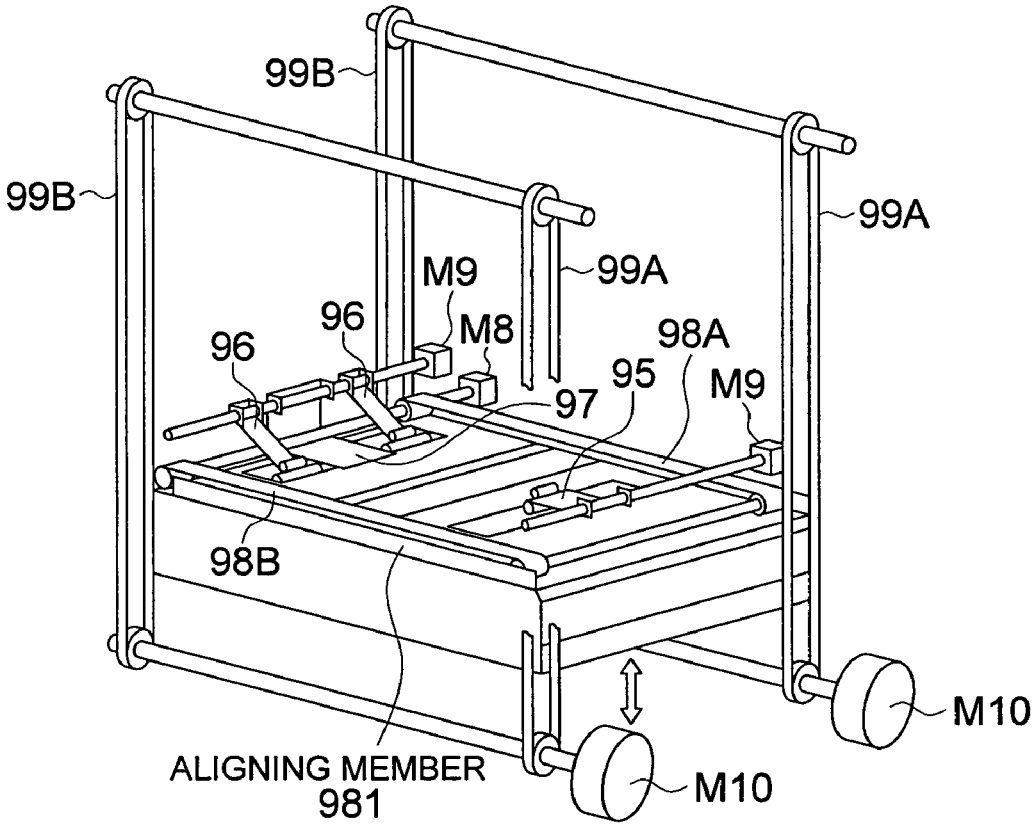
FIG. 5 is a schematic perspective view of the cover supporting section viewed from direction A in FIG. 4.

FIG. 4 is a schematic sectional view relating to cover storing section 80 that stores covers S2 and relating to cover supporting section 90 that supports a cover, while FIG. 5 is a schematic perspective view wherein the cover supporting section 90 in FIG. 4 is viewed in the direction A in FIG. 4.

As shown in FIG. 4, a cover S2 is stored in sheet feeding tray 801 of the cover storing section 80 provided at a lower part of the bookbinding apparatus, and it is fed by sheet feeding/conveyance roller 82, and then, caused to switchback after being aligned by the cover supporting section 90, to be cut by cutter 81 being a cutting unit to the length corresponding to the bundle of sheets S1, and is conveyed by conveyance roller 84 to be placed horizontally on cover supporting unit 901 that is shown with one-dot chain lines. The cover supporting unit 901 includes a plurality of members such as pressing members 91 and 92 and cams 93 and 94 which drive the pressing members 91 and 92.

In the mean time, the cutter 81 cuts the cover S2 to the length based on information of the size of the cover S2, information on the size of sheet S1 and on information on a thickness of a bundle of sheets S1 stored in position detection unit 511. Scraps of the cover S2 are put into a storage box 83.

The cover S2 cut to a certain length is fed out by conveyance roller 84 to be inserted into a clearance of about 5 mm provided between upper guide plate 955 and lower guide plate 956. The cover S2 is conveyed by cover conveyance rollers 951 and driven by rollers 952 which are provided respectively at the tips of cover holding members 95 and 96. The cover S2 is controlled to stop when it comes to a certain position based on information on its size and on information on a thickness of a bundle of sheets S1. Cover holding members 97 moves into a space under the cover to lift the cover.

Figure 6:
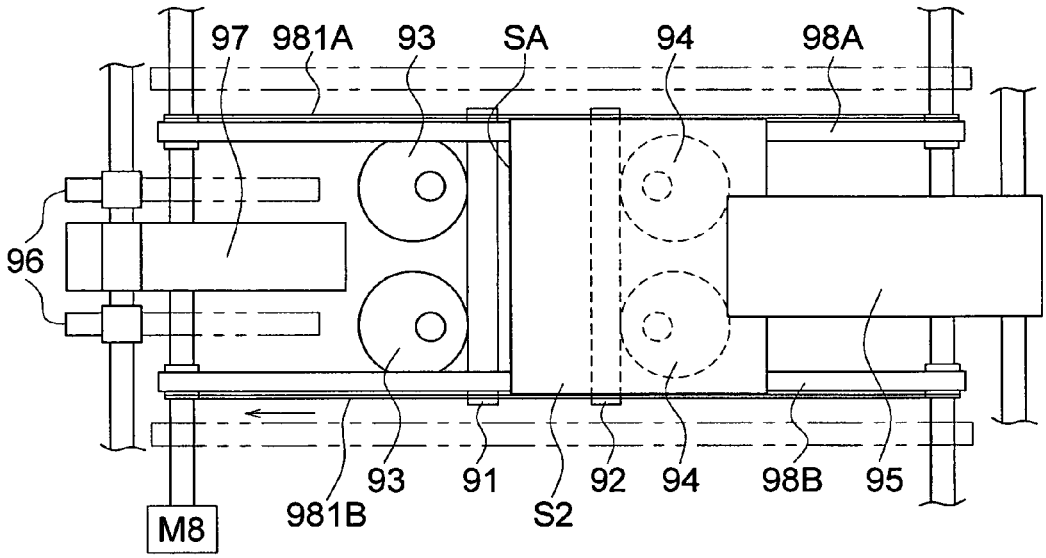
FIG. 6 is a top view of a cover supporting unit.

FIG. 6 is a top view of the cover supporting unit 901.

Belts 98A and 98B conduct aligning operations to correct inclination of conveyed cover S2 and convey the bound book S3 to book ejection section 100.

For the purpose of setting cover S2 at a predetermined position, there are provided aligning members 981A and 981B which align both edges of the cover S2 in the direction parallel to the conveyance direction of the cover S2. Further, on aligning members 981A and 981B, there are provided respective belts 98A and 98B and drum-shaped rollers which support the belts 98A and 98B with tension, and they are movable in the direction of both edges of the cover. The aligning members 981A and 981B conduct aligning operation each time the cover S2 is conveyed. In the aligning operations, both edge portions of the cover move into clearances under the belts 98A and 98B respectively, and respective edge portions are hit slightly to be aligned by aligning members 981A and 981B. Further, when cover supporting unit 901 which will be described later rises, aligning members 981A and 981B as well as belts 98A and 98B are retreated to the position shown with two-dot chain lines in FIG. 6, so that the belts 98A and 98B are retracted from above the cover S2 to avoid a collision.

Figure 7:
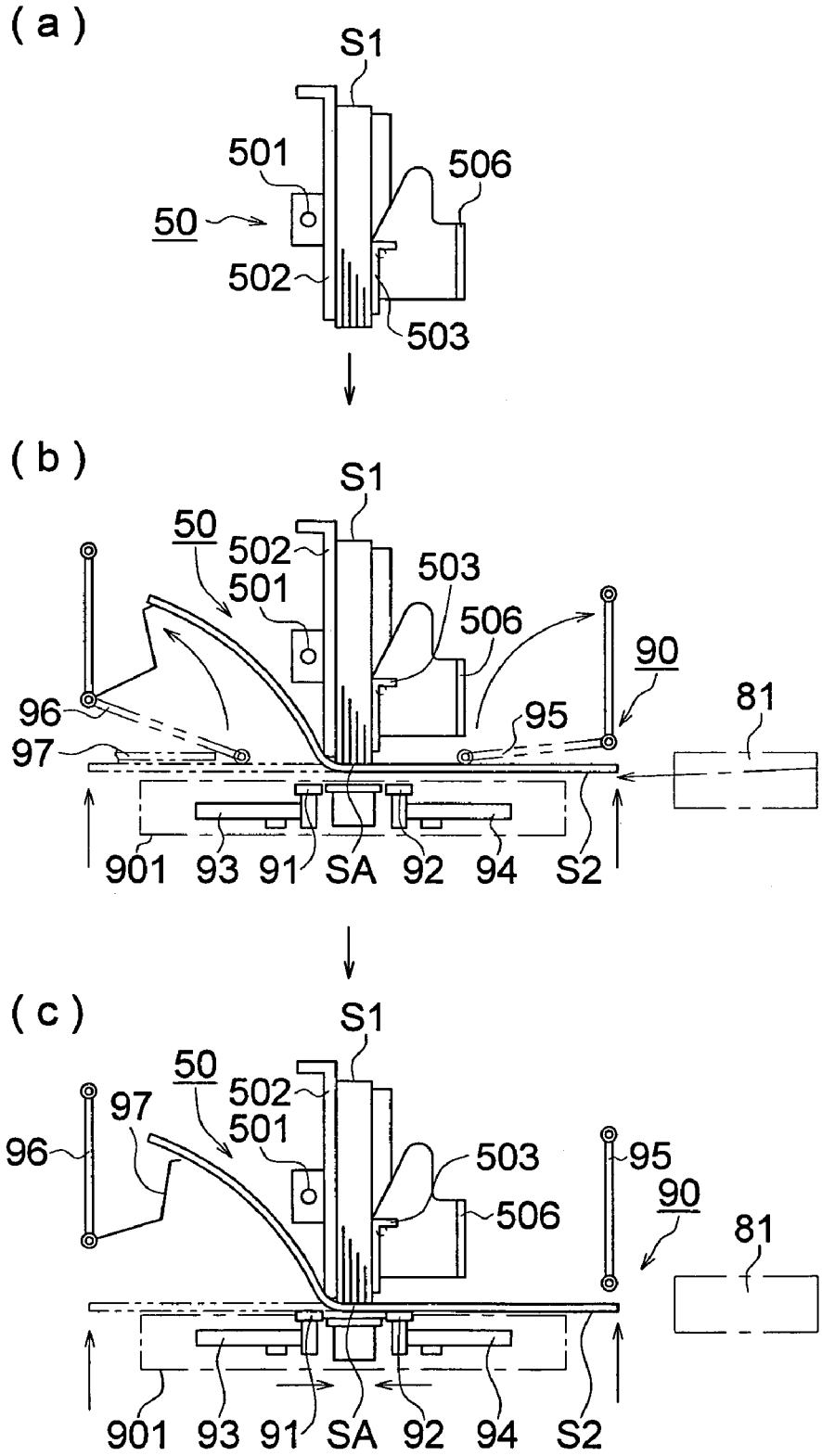
FIG. 7 is a diagram showing how a sheet for a cover is joined with sheets for a book.

FIG. 7 shows the state where belts 99A and 99B (first moving unit) are driven by motor M10, in a state where the cover S2 is raised together with the cover supporting unit 901 while the cover S2 is pressed downward by pressing members 95 and 96.

Diagram (a) of FIG. 7 shows the state where coating of adhesive 653 has been completed. In the state of diagram (a) of FIG. 7, the cover supporting unit 901 is supporting the cover S2 at the lower position that is away from the bottom surface of the bundle of sheets S1, as shown in FIG. 4.

When the cover supporting unit 901 starts to rise, the cover holding members 95 and 96 are holding the cover S2 downward to hold the cover S2 to be flat. Before the cover S2 rises and comes in contact with surface SA of the bundle of sheets S1, motor M9 (see FIG. 5) releases the contact of the cover holding members 95, 96 and 97 with the cover S2, and the state shown by diagram (b) of FIG. 7 is created. In this case, a state is created where the cover S2 is lifted up by the cover holding member 97 that has moved into a space under the cover S2.

The cover supporting unit 901 further rises by several millimeters from the position shown by diagram (b) of FIG. 7. The cover supporting unit 901 is lifted by several millimeters to the position shown by diagram (c) in FIG. 7. After rising, pressing members 91 and 92 press the cover S2 from its both sides to create corners at the boundary between the spine and the front cover and at the boundary between the spine and the back cover, thus, the cover S2 is brought into close contact with the bundle of sheets S1, and book S3 is formed.

The pressing members 91 and 92 are moved in the horizontal direction by cams 93 and 94 (see FIG. 6) driven by a motor (not shown). Incidentally, the pressing members 91 and 92 may also be moved by rotation of a pinion that engages with a rack provided on each member.

Processing of the cover S2 after joining will be described below, referring to FIG. 8.

Figure 8:
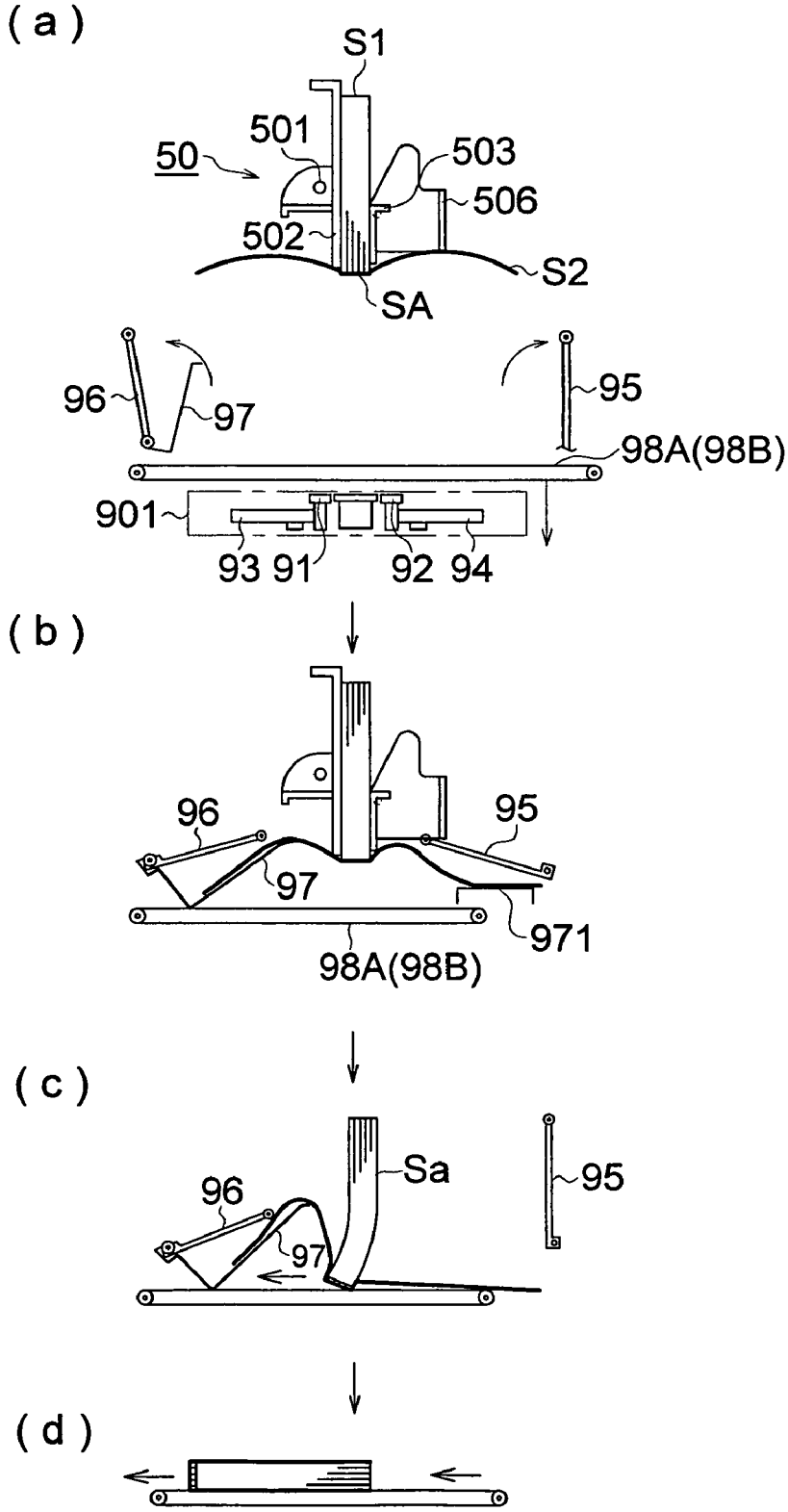
FIG. 8 is a diagram that illustrates processing of a cover after joining.

After joining of the cover S2 is completed, the pressing members 91 and 92 are released, and the cover supporting unit 901 is lowered by about 100 mm by the drive of belts 99A and 99B to return to its home position, as shown by diagram (a) of FIG. 8. Then, the cover S2 is lifted by about 50 mm on its left and right sides in such a manner that cover holding members 95, 96 and 97 become horizontal from their vertical state once and then are rotated reversely again, and cover lifting member 971 is also lifted.

Then, belts 98A and 98B are moved to positions inside the width of the cover S2, and the cover supporting unit 901 is lifted about 70 mm.

Holding plate 503 moves to its retracted position to release the pressing, whereby, book S3 having a bundle of sheets S1 and cover S2 falls onto belts 98A and 98B. Then, motor M8 (see FIG. 5) is driven to circulate belts 98A and 98B while the cover supporting unit 901 is lowered again, to bring the book S3 down while transporting it to the book ejection section 100 side. Herein, the cover holding members 96 and 97 are rotated greatly in the rising direction as shown in diagram (c) of FIG. 8 to lift the cover on the left side. When the cover supporting unit 901 arrives at its home position (diagram (d) of FIG. 8), the book S3 is sent by belts 98A and 98B to the left end, to be ejected to book ejection section 100 as it is.

Sheet ejection table 101 is lifted and lowered, driven by a belt. The sheet ejection table 101, on which book S3 is loaded, is lowered to deliver the book S3 to belt 102, and belt 102 conveys the book S3 to eject it from the bookbinding apparatus.

<Wave Amount>

Now, a wave amount detection unit will be described. In general, an image forming device employing an electrophotographic system has therein a fixing unit that heats and fixes toner images transferred on a sheet. When toner images are heated and fixed, moisture contained in the sheet S1 itself evaporates, and sheet S1 shrinks and waves are generated when the sheet S1 is ejected out of the device.

Therefore, there is generated a difference between an actual thickness of a bundle of sheets calculated from a value stored in a storage device of position detection unit 511 (see FIG. 2) and a theoretical thickness of the bundle of sheets obtained by a product of a thickness per sheet and a counted quantity of sheets, such as a quantity of document sheets counted by an automatic document conveyance unit of the aforesaid image forming device. This difference is referred to as a wave amount. In other words, when the wave amount is great, the actual measurement value is much greater than the theoretical value, while, when the wave amount is substantially zero, the actual measurement value is substantially the same as the theoretical value.

If a value of this wave amount is great, there is caused a problem that a corner section (referred to as a book corner section) formed on each of the boundary between a spine and a front cover and the boundary between the spine and a back cover does not result in a straight line, and irregularities are generated on a flat section of the spine to decline quality of bookbinding.

To solve this problem, the pressing time period with pressing members was made variable, corresponding to the wave amount. Table 1 shows values of relationship between the pressing time (back corner forming time) with pressing members 91 and 92 which press the cover S2 from both sides thereof and the wave amount, the values being obtained from experiments.

The bookbinding apparatus has a control unit which has therein incorporated data of Table 1 and performs control so that back corners can be properly formed, making the back corner forming time automatically variable based on the data.

TABLE 1

| Wave amount W (mm) | Back corner forming time (sec.) |
|---|---|
| $0 \leqq W < 3$ | 10 |
| $3 \leqq W < 7$ | 15 |
| $7 \leqq W$ | 20 |

In Table 1, when the wave amount is smaller than 3 mm, for example, the back corner forming time is 10 sec. When the wave amount is not smaller then 3 mm and smaller than 7 mm, the back corner forming time is 15 sec, and when the wave amount is 7 mm or greater, the back corner forming time is 20 sec. Motor M4 that rotates cams 93 and 94 is driven until the moment when the current value of the motor M4 reaches a predetermined limit current value, to press a bundle of sheets and cover S2 with pressing members 91 and 92. After keeping the stopping state of the motor M4 such that the state of this pressing is kept for the back corner forming time corresponding to each wave amount, the motor M4 is driven again to release the pressing. In the case of the aforesaid mechanism to move the pressing members 91 and 92 by the rack and pinion, the motor M4 that rotates the pinion is driven until the moment when a current value of the motor M4 reaches a predetermined limit current value, to press a bundle of sheets and the cover S2 with the pressing members 91 and 92. After keeping the state of pressing for the back corner forming time corresponding to each wave amount, the pinion is rotated reversely by the reverse rotation of the motor M4 to release the pressing.

As a device to form proper back corners, a device to control a pressing force given to the pressing members 91 and 92 may also be used, in addition to the device to control the aforesaid back corner forming time. The pressing force can be controlled through the control of limit current that drives motor M4. Table 2 shows values of experiments wherein the limit current value is converted to the pressing force.

TABLE 2

| Wave amount W (mm) | Pressing force (N) | Current value |
|---|---|---|
| $0 \leqq W < 3$ | 200 | 1.5 A |
| $3 \leqq W < 7$ | 300 | 2.0 A |
| $7 \leqq W$ | 400 | 2.5 A |

In Table 2, when the wave amount is smaller than 3 mm, for example, the required pressing force is 200 N (Newton). When the wave amount is not smaller than 3 mm and smaller than 7 mm, the pressing force is 300 N, and when the wave amount is 7 mm or greater, the pressing force is 400 N. Motor M4 that rotates cams 93 and 94 continues to be driven until the moment when a current value of the motor M4 reaches a limit current value corresponding to each wave amount. When the current value of the motor M4 reaches a limit current value, the motor M4 is stopped so as to keep the state of pressing with the pressing members 91 and 92 for a predetermined time, and then, the motor M4 is driven again to release the pressing. Further, in the case of the mechanism to move pressing members 91 and 92 with a rack and a pinion as mentioned above, the motor M4 continues to be driven until the moment when the driving current value of the motor M4 that rotates the pinion reaches a limit current value corresponding to each wave amount. When the current value of the motor M4 reaches a limit current value, the motor M4 is stopped so as to keep the state of pressing for a predetermined time, and then, the motor M4 is rotated reversely to release the pressing.

Further, as shown in Table 3, it is possible to shorten the back corner forming time by controlling both the back corner forming time and the limit current value. Thus, the bookbinding time is shortened, resulting in an improvement of productivity.

TABLE 3

| Wave amount W (mm) | Pressing force (N) | Back corner forming time (sec.) |
|---|---|---|
| $0 \leqq W < 3$ | 200 | 7 |
| $3 \leqq W < 7$ | 300 | 10 |
| $7 \leqq W$ | 400 | 15 |

Namely, after starting the drive of motor M4 that rotates cams 93 and 94 or a pinion, the drive is continued until the moment when the current value reaches the limit current value corresponding to each wave amount, then the drive is stopped at a point of time when the current value reaches the limit current value, and the state of the stopping is kept for the back corner forming time corresponding to each wave amount. After that, the drive of the pressing members 91 and 92 is released.

Figure 9:
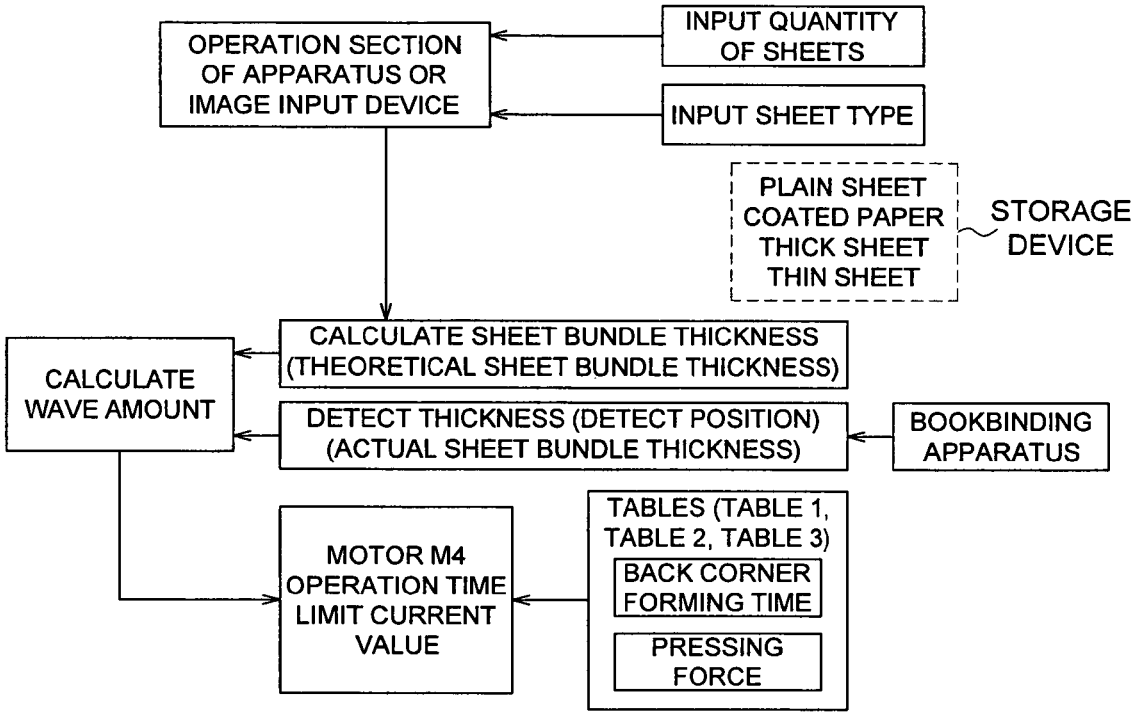
FIG. 9 is a schematic diagram indicating steps up to back corner forming.

FIG. 9 is a schematic diagram indicating the flow up to conducting back corner forming. A quantity of sheets is recognized, as described above, according to the quantity of documents which has been automatically counted or has been input by an operator via an operation section, not shown, of an image forming device or an image input device such as a personal computer. A type of sheets is input by the operator as well. Regarding sheet types, sheet thicknesses for plain paper, coated paper, etc. are stored in a storage device in advance. At the point of time when the quantity of sheets is inputted, a thickness of a bundle of sheets is calculated.

A wave amount is calculated based on an actual thickness of a bundle of sheets calculated from a value stored in a storage device of position detection unit 511, and based on a thickness of a bundle of sheets calculated theoretically. The operation time period of motor M4 and/or the limit current value is controlled according to values in Table 1, Table 2 or Table 3.

Bookbinding that forms straight book corner sections and a flat section of the spine without irregularities has been attained, with a device to detect the wave amount, and through control of either the time period or the pressing force to form back corners or through control of the both, based on the result of the detection of the wave amount.

In the present embodiment, it is possible to provide a bookbinding apparatus that allows binding a high quality book wherein corners of a spine after bookbinding are straight and the spine is flat, by detecting the wave amount of a bundle of sheets and controlling folding processing of the spine based on the result of the aforesaid detection.

What is claimed is:

1. A bookbinding apparatus that wraps a bundle of sheets with a cover and forms back corners, comprising:

a detecting unit for detecting the wave amount of a bundle of sheets, based on difference between a theoretical thickness of the bundle of sheets, obtained from a number of the sheets and a thickness per sheet, and a measured thickness of the bundle of sheets obtained by measuring with a pressing force on the bundle; and a controller to control a time period to form back corners, based on a result of detection by the detecting unit.

2. The bookbinding apparatus of claim 1, comprising:

a supporting plate and holding plate for sandwiching a bundle of sheets, wherein the supporting plate is fixed at a predetermined position;

the holding plate is movable in a direction where the holding plate moves away from the supporting plate; and the thickness of the bundle of sheets is measured, based on a position where the holding plate has stopped with the bundle of sheets sandwiched between the supporting plate and holding plate.

3. The bookbinding apparatus of claim 1, comprising:

a coating unit for coating an adhesive on one side surface of a bundle of sheets; and a cover supporting unit for supporting a cover to join the cover to the one side surface of the bundle of the sheets on which the adhesive has been coated by the coating unit.

4. The bookbinding apparatus of claim 1, comprising:

a pair of pressing members for pressing joined bundle of sheets and a cover, wherein operation of the pressing members is controlled while back corners are formed.

5. A bookbinding apparatus that wraps a bundle of sheets with a cover and forms back corners, comprising:

a detecting unit for detecting the wave amount of a bundle of sheets detects the wave amount, based on difference between a theoretical thickness of the bundle of sheets, obtained from a number of the sheets and a thickness per sheet, and a measured thickness of the bundle of sheets obtained by measuring with a pressing force on the bundle; and a controller to control a pressing force applied to form back corners, based on a result of detection by the detecting unit.

6. The bookbinding apparatus of claim 5, comprising:

a supporting plate and holding plate for sandwiching and holding a bundle of sheets, wherein the supporting plate is fixed at a predetermined position;

the holding plate is movable in a direction where the holding plate moves away from the supporting plate; and the thickness of the bundle of sheets is measured, based on a position where the holding plate has stopped with the bundle of sheets sandwiched between the supporting plate and holding plate.

7. The bookbinding apparatus of claim 5, comprising:

a coating unit for coating an adhesive on one side surface of a bundle of sheets; and a cover supporting unit for supporting a cover to join the cover to the one side surface of the bundle of the sheets on which the adhesive has been coated by the coating unit.

8. The bookbinding apparatus of claim 5, comprising:

a pair of pressing members for pressing joined bundle of sheets and a cover, wherein operation of the pressing members is controlled while back corners are formed.

9. A bookbinding apparatus of that wraps a bundle of sheets with a cover and forms back corners, comprising:

a detecting unit for detecting the wave amount of a bundle of sheets detects the wave amount, based on difference between a theoretical thickness of the bundle of sheets, obtained from a number of the sheets and a thickness per sheet, and a measured thickness of the bundle of sheets obtained by measuring with a pressing force on the bundle; and a controller to control a time period and a pressing force applied to form back corners, based on a result of detection by the detecting unit.

10. The bookbinding apparatus of claim 9, comprising:

a supporting plate and holding plate for sandwiching and holding a bundle of sheets, wherein the supporting plate is fixed at a predetermined position;

the holding plate is movable in a direction where the holding plate moves away from the supporting plate; and the thickness of the bundle of sheets is measured, based on a position where the holding plate has stopped with the bundle of sheets sandwiched between the supporting plate and holding plate.

11. The bookbinding apparatus of claim 9, comprising:

a coating unit for coating an adhesive on one side surface of a bundle of sheets; and a cover supporting unit for supporting a cover to join the cover to the one side surface of the bundle of the sheets on which the adhesive has been coated by the coating unit.

12. The bookbinding apparatus of claim 9, comprising:

a pair of pressing members for pressing joined bundle of sheets and a cover, wherein operation of the pressing members is controlled while back corners are formed.

* * * * *

UNITED STATES PATENT AND TRADEMARK OFFICE

CERTIFICATE OF CORRECTION

PATENT NO. : 7,658,584 B2
APPLICATION NO. : 11/453905
DATED : February 9, 2010
INVENTOR(S) : Yoshie et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 813 days.

Signed and Sealed this

Twenty-eighth Day of December, 2010

David J. Kappos

David J. Kappos
*Director of the United States Patent and Trademark Office*